US012635807B2

(12) United States Patent
Kumamoto et al.

(10) Patent No.: US 12,635,807 B2
(45) Date of Patent: May 26, 2026

(54) AIR MATTRESS

(71) Applicant: PARAMOUNT BED CO., LTD., Tokyo (JP)

(72) Inventors: Tsuyoshi Kumamoto, Tokyo (JP); Makoto Tanaka, Tokyo (JP); Masakazu Harada, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 0 days.

(21) Appl. No.: 18/987,485

(22) Filed: Dec. 19, 2024

(65) Prior Publication Data

US 2026/0083254 A1 Mar. 26, 2026

(30) Foreign Application Priority Data

Sep. 20, 2024 (JP) ..... 2024-164115

(51) Int. Cl.
*A47C 27/08* (2006.01)

(52) U.S. Cl.
CPC ..... *A47C 27/081* (2013.01)

(58) Field of Classification Search
CPC ..... A47C 27/08; A47C 27/081; A47C 27/082; A47C 7/744; A61G 7/05776; A61G 7/05784; A61G 7/05792
See application file for complete search history.

(56) References Cited

U.S. PATENT DOCUMENTS 4,914,771 A * 4/1990 Afeyan ..... A61G 7/05792 5/713
4,999,074 A * 3/1991 Afeyan ..... A61G 7/05792 428/188
5,539,942 A * 7/1996 Melou ..... A61G 7/05792 5/655.3
5,584,085 A * 12/1996 Banko ..... A61G 7/05784 5/713
5,926,884 A * 7/1999 Biggie ..... A61G 7/05792 5/713
2001/0052152 A1* 12/2001 Soltani ..... A61G 7/05746 5/689
2004/0237203 A1* 12/2004 Romano ..... A61G 7/05776 5/713
2011/0068939 A1* 3/2011 Lachenbruch ..... A61G 7/0525 340/626
2011/0252571 A1* 10/2011 Liu ..... A47C 27/081 5/713
2014/0109314 A1* 4/2014 Boersma ..... A47C 21/048 5/423

(Continued)

FOREIGN PATENT DOCUMENTS

JP H 09154669 A 6/1997

*Primary Examiner* — Justin C Mikowski
*Assistant Examiner* — Ifeolu A Adeboyejo
(74) *Attorney, Agent, or Firm* — Knobbe, Martens, Olson & Bear, LLP

(57) ABSTRACT

An air mattress includes a supply unit, a first path, a second path, a first flow path part, a second flow path part, a bag part, a plurality of cells, and a pressure controller, the pressure controller performs control to set the pressure inside any one or more of the plurality of cells at the first pressure, when the user lies on the air mattress, the air circulates through at least a part of the bag part located above the cells, whose pressure is set at the second pressure or lower, out of the plurality of cells.

12 Claims, 6 Drawing Sheets

(56) References Cited

U.S. PATENT DOCUMENTS

| | | | | |
|---|---|---|---|---|
| 2015/0000044 | A1* | 1/2015 | Morimura | A47C 27/083 5/710 |
| 2016/0135607 | A1* | 5/2016 | Ocegueda | A47C 27/082 5/423 |
| 2017/0150822 | A1* | 6/2017 | Ghanei | A47C 27/007 |

* cited by examiner

AIR MATTRESS

CROSS-REFERENCE TO RELATED APPLICATIONS

This application is based upon and claims the benefit of priority from Japanese Patent Application No. 2024-164115, filed on Sep. 20, 2024; the entire contents of which are incorporated herein by reference.

FIELD

An embodiment of the present disclosure relates to an air mattress.

BACKGROUND

Air mattresses may be disposed on beds in medical institutions such as a hospital. The air mattress includes multiple air cells, and can maintain the user's comfort during sleep by controlling the pressure in the air cells.

For example, an air mattress having a structure in which air-permeable urethane or the like is wrapped with a moisture-permeable outer skin is disposed between the bed's user and bed sections, is provided with a blowout port and a suction port near both end parts thereof in a longitudinal direction, and prevents bedsores and keeps skin temperature and humidity properly by circulating the air using an air blowing unit such as a blower.

DETAILED DESCRIPTION

Figure 1:
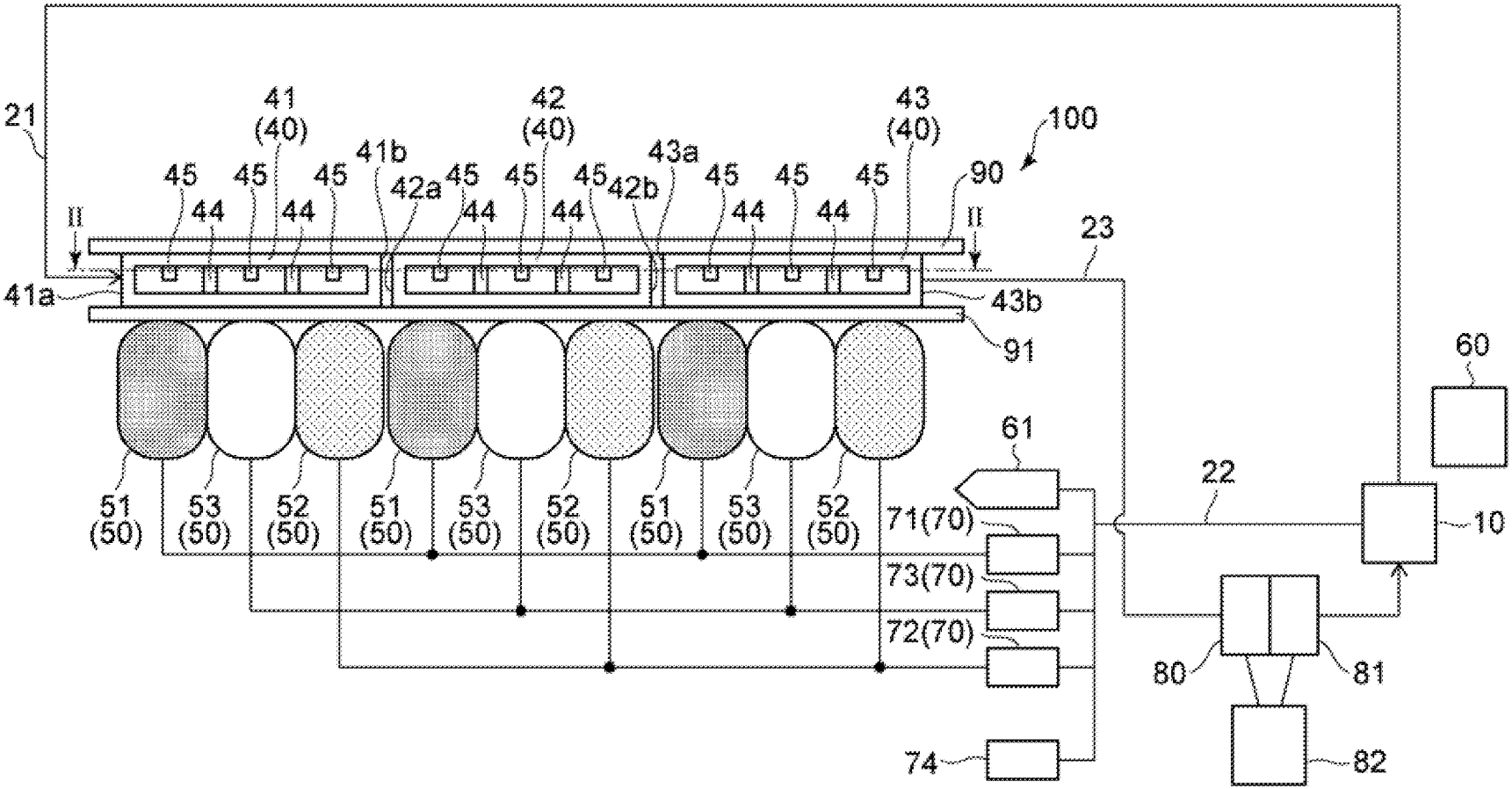
FIG. 1 illustrates the air mattress according to the embodiment.

One or more embodiments are now described with reference to the drawings, wherein like reference numerals are used to refer to like elements throughout. In the following description, for purposes of explanation, numerous specific details are set forth in order to provide a thorough understanding of the various embodiments. It is evident, however, that the various embodiments can be practiced without these specific details (and without applying to any particular networked environment or standard).

As used in this disclosure, in some embodiments, the terms "component," "system" and the like are intended to refer to, or comprise, a computer-related entity or an entity related to an operational apparatus with one or more specific functionalities, wherein the entity can be either hardware, or a combination of hardware and software in execution.

One or more components may reside within a process and/or thread of execution and a component may be localized on one computer and/or distributed between two or more computers. In addition, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software application or firmware application executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software stored on a non-transitory electronic memory or firmware that confers at least in part the functionality of the electronic components. While various components have been illustrated as separate components, it will be appreciated that multiple components can be implemented as a single component, or a single component can be implemented as multiple components, without departing from example embodiments. Further, the various embodiments can be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer-readable (or machine-readable) device or computer-readable (or machine-readable) storage/communications media having a computer program stored thereon. For example, computer readable storage media can comprise, but are not limited to, magnetic storage devices (e.g., hard disk, floppy disk, magnetic strips), optical disks (e.g., compact disk (CD), digital versatile disk (DVD)), smart cards, and flash memory devices (e.g., card, stick, key drive). Of course, those skilled in the art will recognize many modifications can be made to this configuration without departing from the scope or spirit of the various embodiments.

In addition, the words "example" and "exemplary" are used herein to mean serving as an instance or illustration. Any embodiment or design described herein as "example" or "exemplary" is not necessarily to be construed as preferred or advantageous over other embodiments or designs. Rather, use of the word example or exemplary is intended to present concepts in a concrete fashion. As used in this application, the term "or" is intended to mean an inclusive "or" rather than an exclusive "or". That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Embodiments described herein can be exploited in substantially any wireless communication technology, comprising, but not limited to, wireless fidelity (Wi-Fi), global system for mobile communications (GSM), universal mobile telecommunications system (UMTS), worldwide interoperability for microwave access (WiMAX), enhanced general packet radio service (enhanced GPRS), third generation partnership project (3GPP) long term evolution (LTE), third generation partnership project 2 (3GPP2) ultra mobile broadband (UMB), high speed packet access (HSPA), Z-Wave, Zigbee and other 802.XX wireless technologies and/or legacy telecommunication technologies.

In general, one aspect of the present application is an air mattress including:

a supply unit which is configured to supply an air;

a first path and a second path which are supplied with the air from the supply unit;

a first flow path part and a second flow path part which are provided at both ends in a lateral direction and extend in a longitudinal direction, the first flow path part being supplied with the air from the supply unit via the first path, the second flow path part being supplied with the air via the first flow path part;

a bag part whose surface, pressed by a user at least when the user lies on the air mattress, is at least partially formed of a moisture-permeable sheet, which is supplied with the air from the first flow path part and causes the air to circulate at least in the lateral direction, and which is provided between the first flow path part and the second flow path part;

a plurality of cells which are arranged below the bag part at a position between one end and the other end thereof in the longitudinal direction, which extend in the lateral direction, and which are supplied with the air from the supply unit via the second path; and a pressure controller which is configured to control pressure inside the plurality of cells, in which the pressure inside the plurality of cells includes a first pressure and a second pressure or lower, the second pressure being lower than the first pressure, among the plurality of cells, the pressure controller performs control to set the pressure inside any one or more of the plurality of cells at the first pressure, performs control to set the pressure inside the cells other than the cells, whose pressure is set at the first pressure, at the second pressure or lower and, among the plurality of cells, sequentially switches the cells between the cells set at the first pressure and the cells set at the second pressure or lower, and when the user lies on the air mattress, the air circulates through at least a part of the bag part located above the cells, whose pressure is set at the second pressure or lower, out of the plurality of cells.

Hereinafter, an embodiment of the present disclosure will be described with reference to the drawings.

In the present specification, in a case where a user is lying in a supine position on a bed or mattress, when the user is viewed from his/her body, a direction in which his/her head is located is referred to as a "head side", a direction in which his/her feet are located is referred to as a "foot side", a direction in which his/her right hand is located is referred to as a "right side", a direction in which his/her left hand is located is referred to as a "left side", a direction in which a floor surface of a room is located is referred to as a "lower side", and a direction in which a ceiling is located is referred to as an "upper side". The right side and the left side are also collectively referred to as a "lateral direction", the head side and the foot side are also collectively referred to as a "longitudinal direction", and the upper side and the lower side are also collectively referred to as a "vertical direction".

An air mattress 100 according to the present embodiment will be described. The air mattress 100 according to the present embodiment is placed and used on a medical bed, for example. The user gets on the air mattress 100. Note that, the air mattress 100 may be placed and used on a care bed. The care beds are used in care facilities and homes of users, in addition to medical institutions such as a hospital. The user of the air mattress 100 is, for example, a patient or a care recipient. Besides, the air mattress 100 according to the present embodiment is preferably used for preventing bedsores, and is preferably used as a measure against microclimate which is said to be one of causes of bedsores. Hereinafter, the air mattress 100 according to the present embodiment will be described using the drawings.

Figure 2:
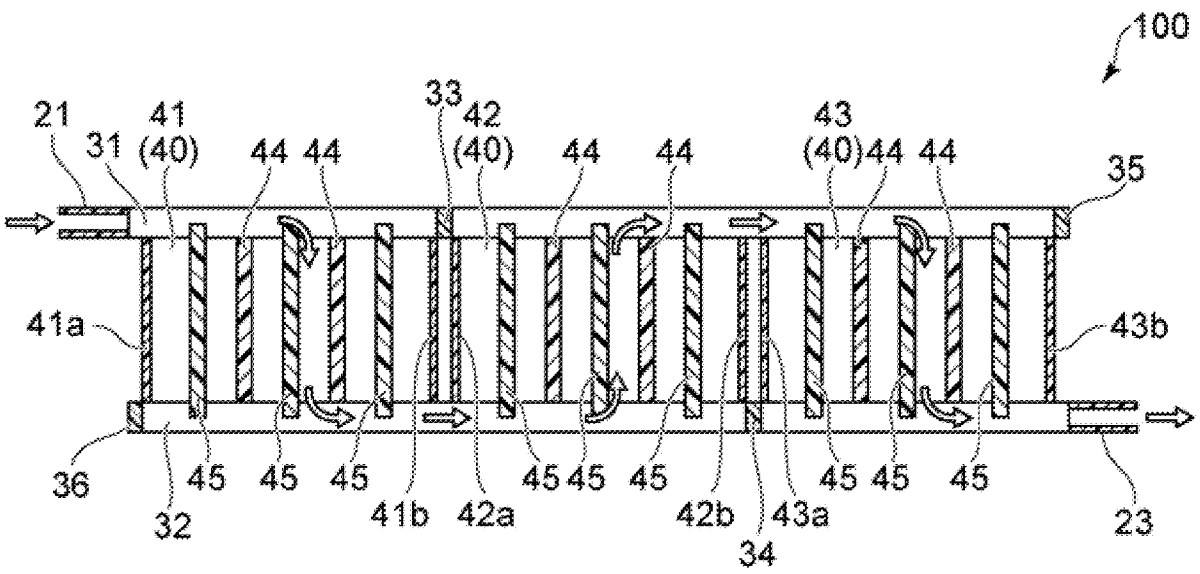
FIG. 2 is a cross-sectional view taken along the line II-II illustrated in FIG. 1.

FIG. 1 illustrates the air mattress 100 according to the embodiment. FIG. 2 is a cross-sectional view taken along the line II-II illustrated in FIG. 1. As illustrated in FIGS. 1 and 2, the air mattress 100 according to the embodiment includes a supply unit 10, a first path 21, a second path 22, a first flow path part 31, a second flow path part 32, bag parts 40, multiple cells 50, and a pressure controller 60. Note that, in the present specification, the left direction is illustrated as the foot side and the right direction is illustrated as the head side in FIGS. 1, 2, 3, 4, 5, and 6.

The supply unit 10 is configured to supply the air. The supply unit 10 may be a pump such as a diaphragm pump, for example. The number of the supply unit 10 may be one or two or more.

The first path 21 and the second path 22 are connected to the supply unit 10 and are supplied with the air from the supply unit 10. The first path 21 and the second path 22 may be piping or the like. Note that, in the present specification, "connection" indicates that a fluid can circulate. Besides the first path 21 and the second path 22, the air mattress 100 according to the embodiment may include a third path 23 that returns the air, having been discharged to the first path 21, to the supply unit 10.

The first flow path part 31 is connected to the first path 21. In addition, the first flow path part 31 is provided at both ends in the lateral direction, extends in the longitudinal direction, and is supplied with the air from the supply unit 10 via the first path 21. The second flow path part 32 is supplied with the air via the first flow path part 31. The first flow path part 31 and the second flow path part 32 may be of a bag shape.

As illustrated in FIG. 2, the bag parts 40 are connected to the first flow path part 31 and the second flow path part 32. In addition, the bag parts 40 are provided between the first flow path part 31 and the second flow path part 32. The bag parts 40 are supplied with the air via the first flow path part 31 and the air circulates therethrough at least in the lateral direction. The air circulates through the bag parts 40 in the longitudinal direction and a direction oblique to the lateral direction and the longitudinal direction in addition to the lateral direction.

As illustrated in FIG. 2, the bag parts 40 may include a first bag part 41, a second bag part 42, and a third bag part 43. Although the three bag parts 40 are illustrated in FIG. 2, the number of the bag parts is not limited to this. The air circulates through the first bag part 41, the second bag part 42, and the third bag part 43 in the longitudinal direction and a direction oblique to the lateral direction and the longitudinal direction in addition to the lateral direction.

An upper material 90 may be provided above the bag parts 40. Besides, a lower material 91 may be provided below the bag parts 40. The upper material 90 and the lower material 91 may be formed of a moisture-permeable sheet.

For example, the multiple cells 50 include first cells 51, second cells 52, and third cells 53. Note that, the number of the multiple cells 50 is not limited. As illustrated in FIG. 1, the sets of the first cell 51, the second cell 52, and the third cell 53 are arranged below the first bag part 41 at a position between one end 41*a* and the other end 41*b* thereof, below the second bag part 42 at a position between one end 42*a* and the other end 42*b* thereof, and below the third bag part 43 at a position between one end 43*a* and the other end 43*b* thereof in the longitudinal direction, respectively.

The first cells 51, the second cells 52, and the third cells 53 extend in the lateral direction. In addition, the first cells 51, the second cells 52, and the third cells 53 are supplied with the air from the supply unit 10 via the second path 22. The heights of the first cells 51, the second cells 52, and the third cells 53 are substantially the same as each other. Further, the sizes and shapes of the first cells 51, the second cells 52, and the third cells 53 may be the same as each other or different from each other.

The supply unit 10 supplies the air to the multiple cells 50, for example, the first flow path part 31, the bag parts 40, and the second flow path part 32 via the first path 21, and supplies the air to the first cells 51, the second cells 52, and the third cells 53 via the second path 22. Meanwhile, the supply unit 10 may be divided into a first supply unit that supplies the air to the first flow path part 31, the bag parts 40, and the second flow path part 32 via the first path 21 and a second supply unit that supplies the air to the first cells 51, the second cells 52, and the third cells 53 via the second path 22.

The pressure controller 60 is configured to control the pressure of the multiple cells 50, for example, the first cells 51, the second cells 52, and the third cells 53, for example. The pressure inside the multiple cells 50 includes a first pressure P1 and a second pressure P2 or less. The second pressure P2 is lower than the first pressure P1. The pressure controller 60 performs control to set the pressure inside any one or more of the multiple cells 50 at the first pressure P1 and performs control to set the pressure inside the cells other than the cells, whose pressure is set at the first pressure P1, at the second pressure P2 or lower. In addition, among the multiple cells 50, the pressure controller 60 sequentially switches the cells between the cells set at the first pressure P1 and the cells set at the second pressure P2 or lower. Hereinbelow, a case where the multiple cells 50 include the first cells 51, the second cells 52, and the third cells 53 will be described as an example.

The pressure controller 60 at least executes a first mode T1, a second mode T2, and a third mode T3. In the first mode T1, the pressure inside the second cells 52 and the pressure inside the third cells 53 are set at the first pressure P1, and the pressure inside the first cells 51 is set at the second pressure P2, which is lower than the first pressure P1, or lower. In the second mode T2, the pressure inside the first cells 51 and the pressure inside the third cells 53 are set at the first pressure P1, and the pressure inside the second cells 52 is set at the second pressure P2 or lower. In the third mode T3, the pressure inside the first cells 51 and the pressure inside the second cells 52 are set at the first pressure P1, and the pressure inside the third cells 53 is set at the second pressure P2 or lower. The above will be described in detail below.

Figure 3:
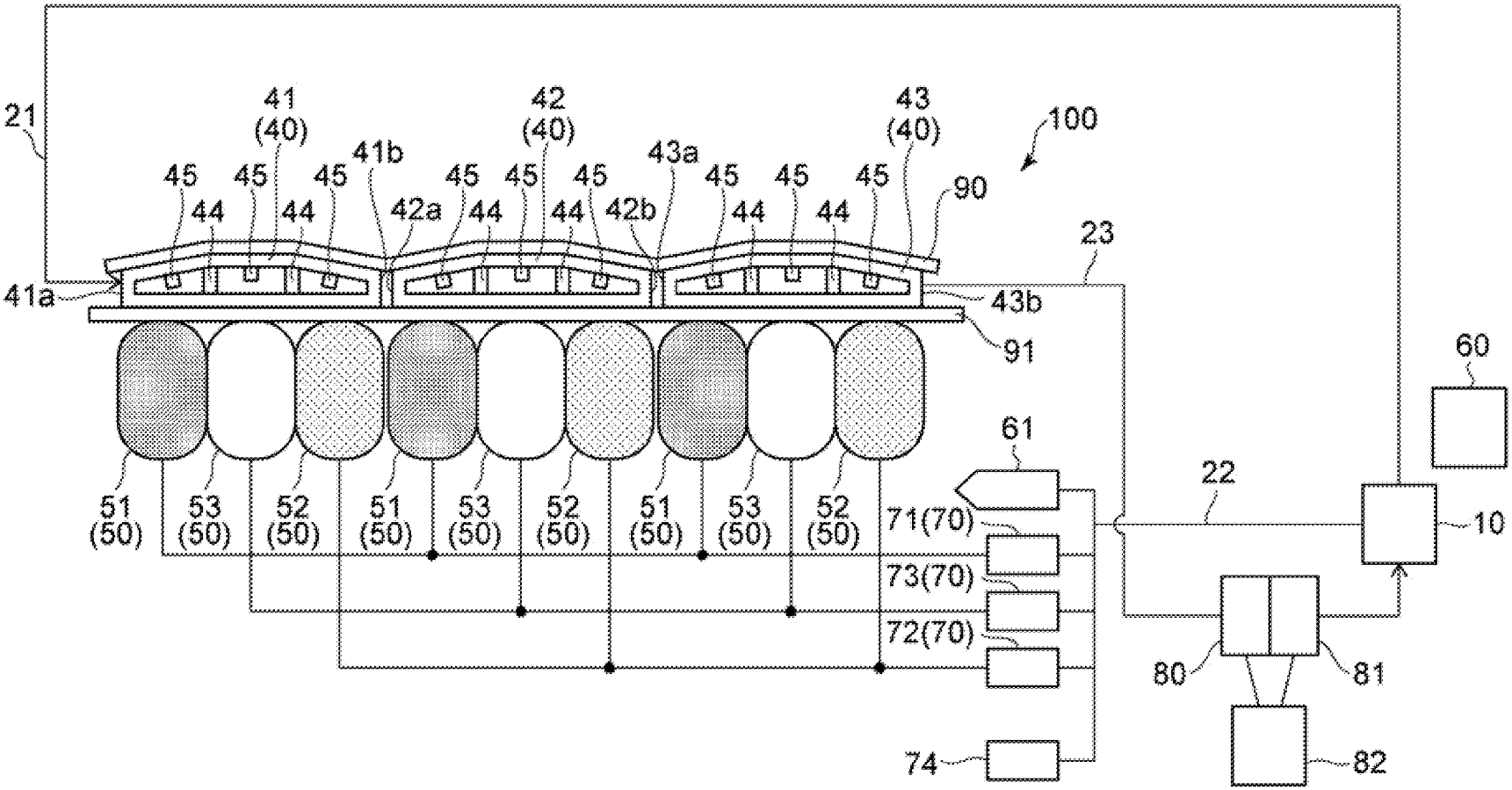
FIG. 3 illustrates a state in which the air is supplied to the bag parts of the air mattress illustrated in FIG. 1.
Figure 4:
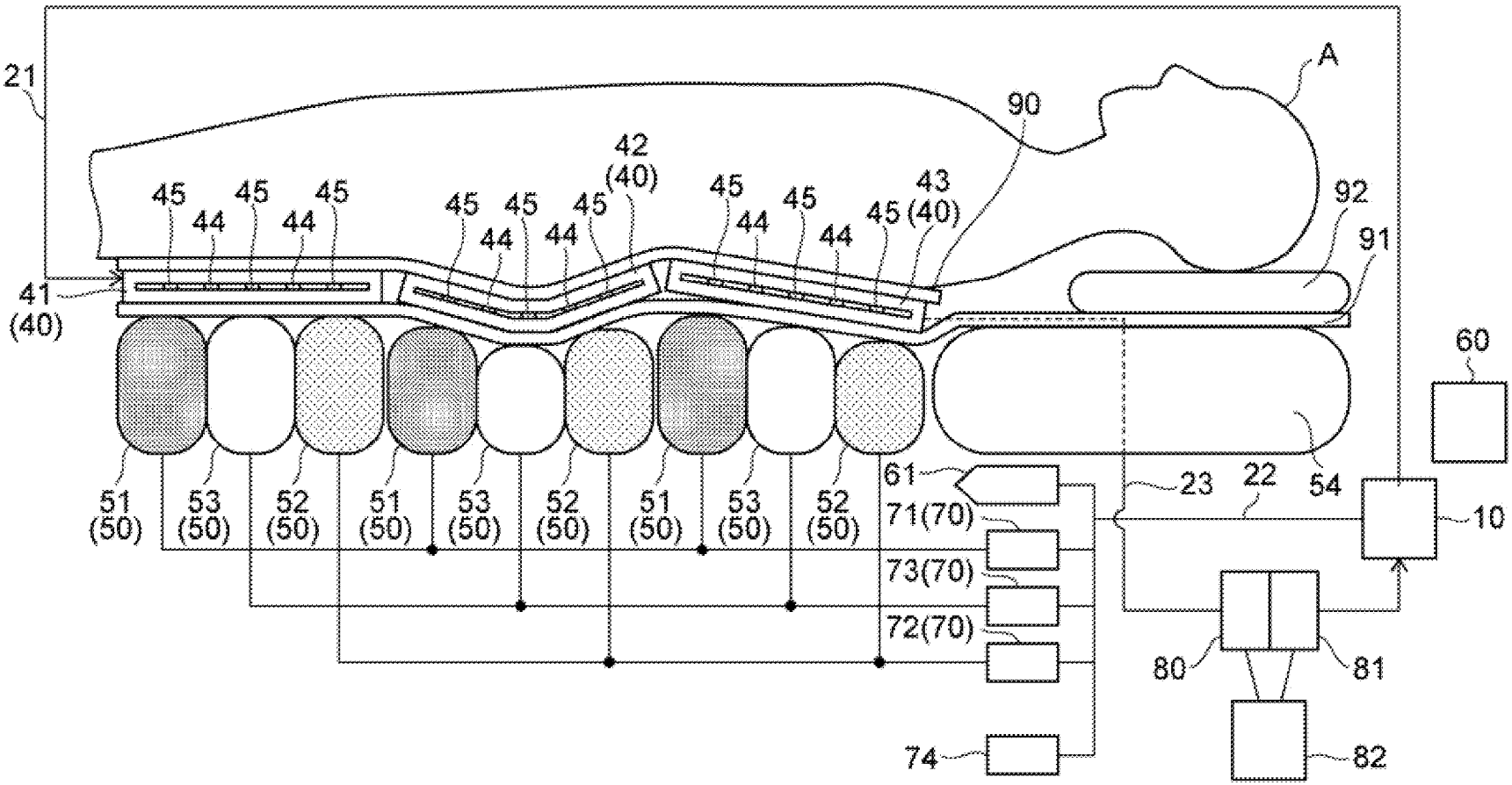
FIG. 4 illustrates a state of the air mattress in a case where a user A lies in a supine position on the air mattress illustrated in FIG. 1.

FIG. 3 illustrates a state in which the air is supplied to the bag parts 40 of the air mattress 100 illustrated in FIG. 1. FIG. 4 illustrates a state of the air mattress 100 in a case where a user A lies in a supine position on the air mattress 100 illustrated in FIG. 1. In the state illustrated in FIG. 3, the user A is not on the air mattress 100, and the bag parts 40, the first cells 51, the second cells 52, and the third cells 53 are inflated. FIG. 4 illustrates that the user A is lying in a supine position on the air mattress 100, and the bag parts 40 are pressed downward and squashed by the weight of the user A. Meanwhile, the first cells 51, the second cells 52, and the third cells 53 are inflated, and the third cells 53, which are located below the second bag part 42 where the weight of the user A is applied most, are smaller than the other cells.

Note that, as illustrated in FIG. 4, the air mattress 100 according to the embodiment includes a pillow 92 below the head of the user A and a head cell 54 below the pillow 92.

The pressure controller 60 implements an initial state. In the initial state, the pressure controller 60 sets the inner pressure of all the first cells 51, the second cells 52, and the third cells 53 at the first pressure P1. As illustrated in FIG. 4, the first pressure P1 is a pressure at which all the first cells 51, the second cells 52, and the third cells 53 are kept inflated in a state where the user A is on the air mattress 100 to thereby enable at least the first cells 51, the second cells 52, and the third cells 53 to support the user A in a comfortable manner. For example, the first pressure P1 is a pressure at which a contact area between the first, second, and third cells 51, 52, and 53 and the user A is the maximum. In an initial state T0, the first pressure P1 is a value set in advance.

Figure 5:
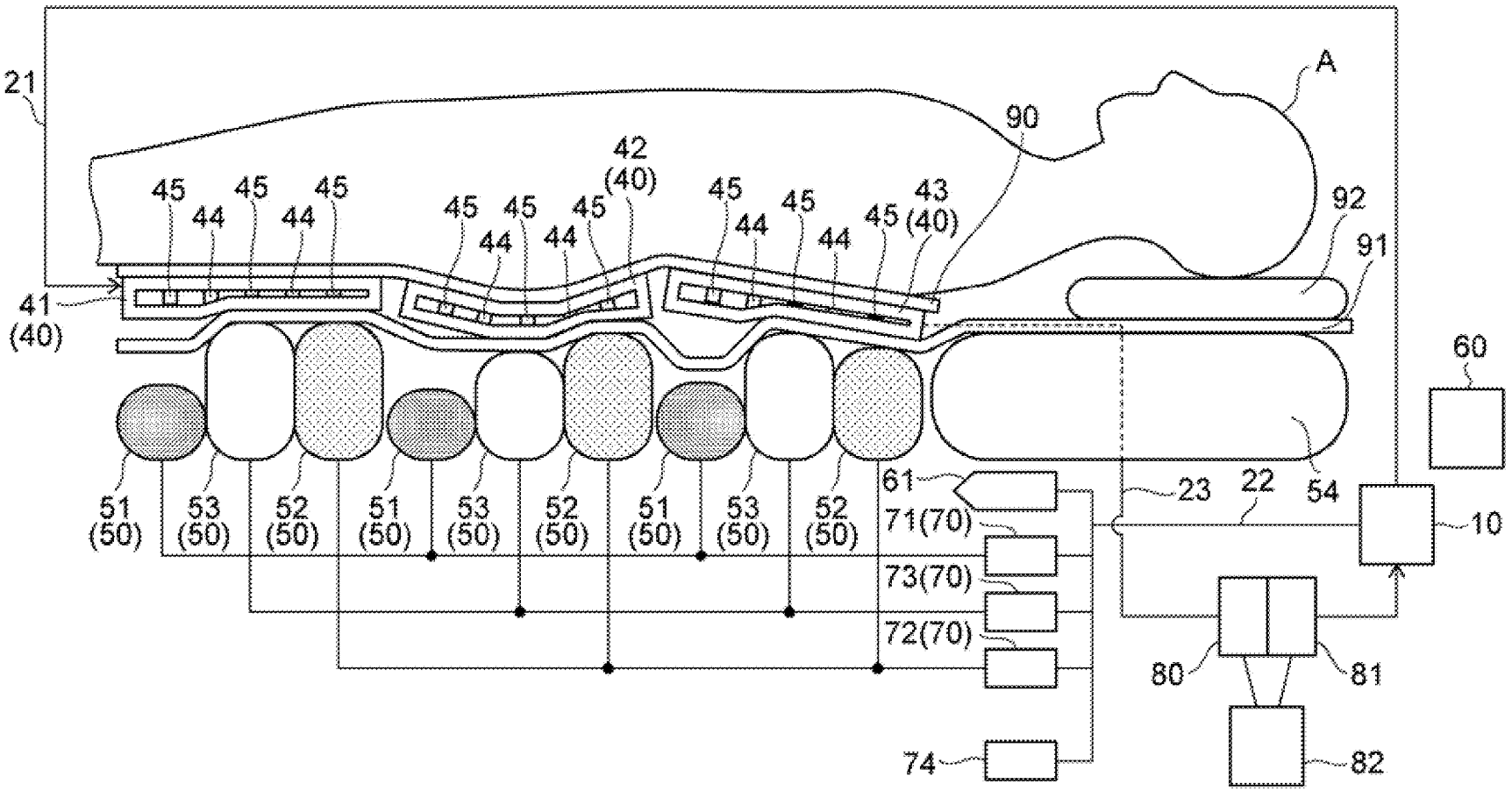
FIG. 5 illustrates a state of the first mode in which the first cells are set at the second pressure, which is lower than the first pressure, or lower in the air mattress illustrated in FIG. 4.
Figure 6:
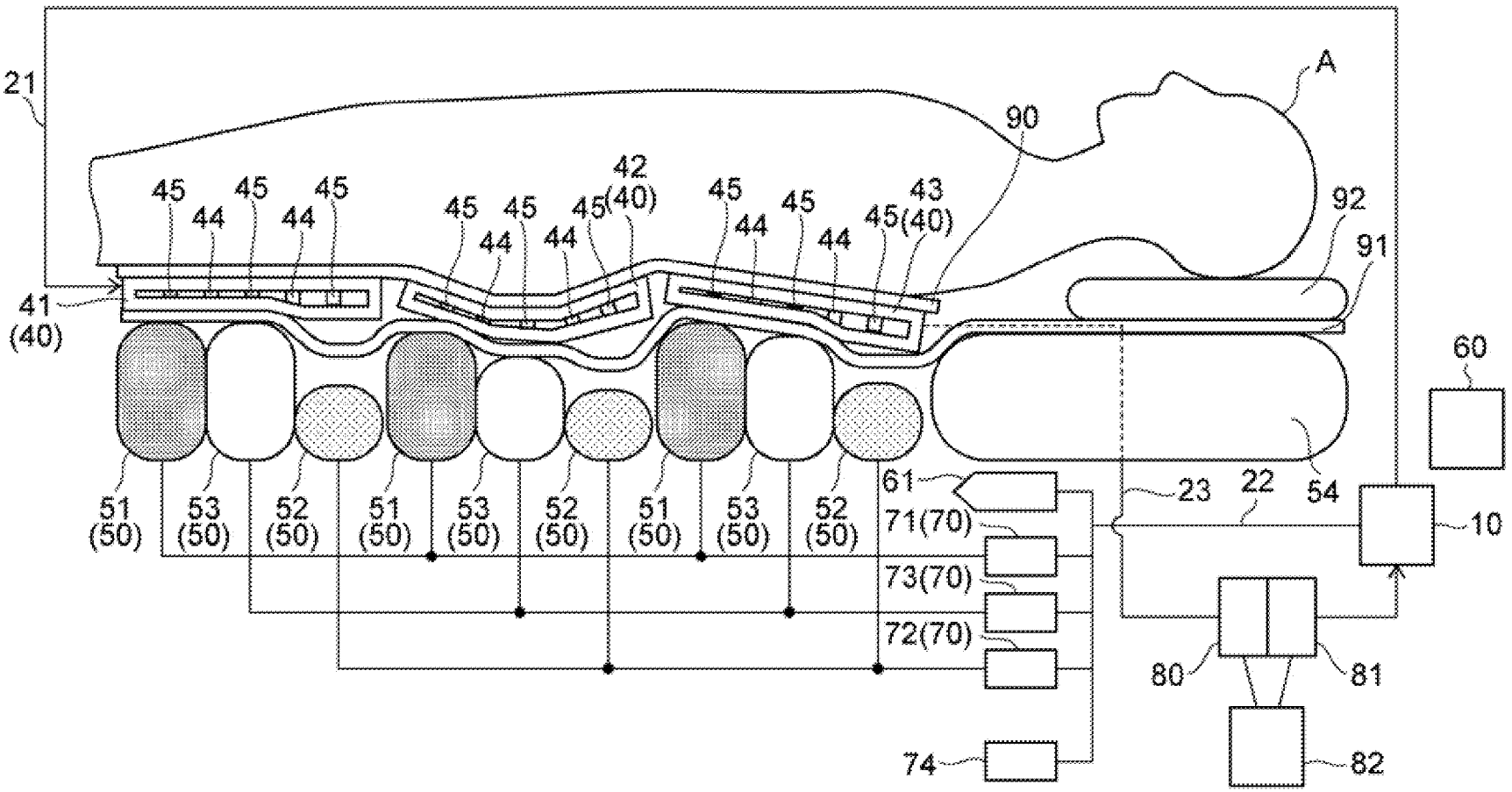
FIG. 6 illustrates a state of the second mode in which the second cells are set at the second pressure, which is lower than the first pressure, or lower in the air mattress illustrated in FIG. 4.

FIG. 5 illustrates a state of the first mode T1 in which the first cells 51 are set at the second pressure P2, which is lower than the first pressure P1, or lower in the air mattress 100 illustrated in FIG. 4. FIG. 6 illustrates a state of the second mode T2 in which the second cells 52 are set at the second pressure P2, which is lower than the first pressure P1, or lower in the air mattress 100 illustrated in FIG. 4.

As illustrated in FIG. 5, in the first mode T1, the pressure inside the second cells 52 and the pressure inside the third cells 53 are set at the first pressure P1, and the pressure inside the first cells 51 is set at the second pressure P2 or lower. The second pressure P2 is lower than the first pressure P1. The pressure inside the first cells 51 is set at a pressure close to the atmospheric pressure, for example. Thus, the user A is supported by the second cells 52 and the third cells 53, and is not supported by the first cells 51. The time period of the first mode T1 is set at five minutes, for example.

As illustrated in FIG. 6, in the second mode T2, the pressure inside the first cells 51 is set back to the first pressure P1, and the pressure inside the second cells 52 is set at the second pressure P2 or lower. The pressure inside the second cells 52 is set at a pressure close to the atmospheric pressure, for example. Thus, the user A is supported by the first cells 51 and the third cells 53, and is not supported by the second cells 52. The time period of the second mode T2 is set at five minutes, for example.

In the third mode T3, the pressure inside the second cells 52 is set back to the first pressure P1, and the pressure inside the third cells 53 is set at the second pressure P2 or lower. The pressure inside the third cells 53 is set at a pressure close to the atmospheric pressure, for example. Thus, the user A is supported by the first cells 51 and the second cells 52, and is not supported by the third cells 53. The time period of the third mode T3 is set at five minutes, for example.

In the air mattress 100 according to the present embodiment, the first mode T1, the second mode T2, and the third mode T3, which are set at the predetermined time periods, are iterated. In this way, the pressure controller 60 decreases the inner pressure of the multiple first cells 51, second cells 52, and third cells 53 to a pressure equal to or lower than the second pressure P2 by turns. This allows a portion of the body of the user A, not pressed by the first cells 51, the second cells 52, and the third cells 53, to be moved little by little, thereby enabling body pressure dispersion and suppressing bedsores.

The case where the multiple cells 50 include the first cell, the second cell, and the third cell has been described as an example, but the number of cells is not limited to this and may be four or more. In addition, the pressure controller 60 may set one or more, or two or more cells at the first pressure P1, and may set one or more, or two or more cells at the second pressure P2. For example, in a case where the number of the multiple cells 50 is four, the pressure controller may set one of the cells at the first pressure P1 and set the other cells at the second pressure P2 or lower, or may set two of the cells at the first pressure P1 and set the other cells at the second pressure P2 or lower. Then, among the multiple cells 50, the pressure controller sequentially switches the cells between the cells set at the first pressure P1 and the cells set at the second pressure P2 or lower. In this case, when the user lies on the air mattress, the air circulates through at least a part of the bag parts 40 located above the cells, whose pressure is set at the second pressure P2 or lower, out of the multiple cells 50.

In order to change the pressure of the first cells 51, the second cells 52, and the third cells 53, the air mattress 100 according to the present embodiment may further include a first solenoid valve 71, a second solenoid valve 72, and a third solenoid valve 73. Each of the first solenoid valve 71, the second solenoid valve 72, and the third solenoid valve 73 includes a first end and a second end, and can switch whether to permit or prohibit circulation of the air between the first end and the second end. The multiple first cells 51 are connected to each other, and are connected to the first end of the first solenoid valve 71. The multiple second cells 52 are connected to each other, and are connected to the first end of the second solenoid valve 72. The multiple third cells 53 are connected to each other, and are connected to the first end of the third solenoid valve 73. The second path 22 is connected to the first solenoid valve 71, the second solenoid valve 72, and the third solenoid valve 73 at a position downstream of the supply unit 10, and is divided into three flow paths by these valves.

The air mattress 100 according to the present embodiment may include an external solenoid valve 74. The external solenoid valve 74 has a first end connected to the outside of the air mattress 100, and can suck in or discharge the air.

In order to grasp the pressure of the first cells 51, the second cells 52, and the third cells 53, the air mattress 100 according to the present embodiment may further include a pressure sensor 61. This enables the pressure controller 60 to precisely control the pressures in the first mode T1, the second mode T2, and the third mode T3. Note that, the pressure sensor 61 is connected to the second path 22.

Next, a description will be given of circulation of the air inside the bag parts 40 in the first mode T1, the second mode T2, and the third mode T3.

In FIG. 3, since the user A is not on the air mattress 100, the bag parts 40 are not squashed and the air can circulate through the bag parts 40. However, as illustrated in FIG. 4, when the user A lies in a supine position on the air mattress 100, the bag parts 40 are squashed and the air becomes hard to circulate through the bag parts 40. To deal with this, as illustrated in FIG. 5 and FIG. 6, in the air mattress 100 according to the present embodiment, when the pressure controller 60 executes the first mode T1 or the second mode T2, the bag parts 40 above the first cells 51 or the second cells 52 are not squashed and the air can circulate through the bag parts 40 in that portion even when the user A lies in a supine position on the air mattress 100. Accordingly, in the air mattress 100 according to the present embodiment, the air can circulate in the lateral direction even when a part of the mattress on the side of the surface where the weight of the user is applied is squashed. In addition, in the air mattress 100 according to the present embodiment, the pressure controller 60 executes the first mode T1, the second mode T2, and the third mode T3, thus enabling body pressure dispersion.

In addition, the air mattress 100 according to the present embodiment, since the pressure controller 60 executes the first mode T1, the second mode T2, and the third mode T3, the air can circulate through the first bag part 41, the second bag part 42, and the third bag part 43 located above the first cells 51, the second cells 52, and the third cells 53 and thereby prevents heat and humidity from being trapped in the portion where the user A is in contact with the air mattress 100, which is effective for preventing bedsores.

As illustrated in FIG. 1 and the like, each bag part 40 preferably includes therein first elastic bodies 44 that extend in the lateral direction and in the vertical direction which is a thickness direction of the bag part 40. Each bag part 40 preferably also includes therein second elastic bodies 45 that extend in the lateral direction and in the vertical direction, which is the thickness direction, and are thinner than the first elastic bodies 44. In other words, as illustrated in FIG. 1, the second elastic bodies 45 are shorter than the first elastic bodies 44 in the vertical direction. The first elastic bodies 44 and the second elastic bodies 45 may extend from the upper side to the lower side in the bag part 40, or alternatively may extend from the lower side to the upper side in the bag part 40.

The first elastic bodies 44 and the second elastic bodies 45 may be composed of any material as long as they are made of an elastic material and they do not produce any adverse effect in terms of bedsores. Examples of the first elastic bodies 44 and the second elastic bodies 45 include a sponge and rubber, for example.

Since having the first elastic bodies 44, the air mattress 100 according to the present embodiment can prevent at least a part of the bag parts 40, located on the side of the surface of the air mattress where the weight of the user A is applied, from being completely squashed and stopping circulation of the air. The first elastic bodies 44 assist in circulation of the air through the bag parts 40. Note that, in order to efficiently exhibit the above effect, the first elastic bodies 44 are preferably arranged at positions inside the bag parts 40 above positions where the first cells 51 and the third cells 53 abut on each other, and arranged at positions inside the bag parts 40 above positions where the second cells 52 and the third cells 53 abut on each other.

In addition, since having the second elastic bodies 45, the air mattress 100 according to the present embodiment can prevent at least a part of the bag parts 40, located on the side of the surface of the air mattress where the weight of the user A is applied, from being completely squashed and stopping circulation of the air and prevent an upper portion and a lower portion of the bag parts 40 from being attached to each other, thus enabling the air to reliably circulate through the first bag part 41, the second bag part 42, and the third bag part 43 that are located above the first cells 51, the second cells 52, and the third cells 53. The second elastic bodies 45 assist in circulation of the air through the bag parts 40. Note that, in order to efficiently exhibit the above effect, the second elastic bodies 45 are preferably arranged at positions inside the bag parts 40 above positions corresponding to central positions in the longitudinal direction of the first cells 51, the second cells 52, and the third cells 53.

As illustrated in FIG. 2, the second elastic bodies 45 preferably extend from the bag parts 40 into a part of the first flow path part 31 and preferably extend from the bag parts 40 into a part of the second flow path part 32. This enables the air flowing through the first flow path part 31 and the second flow path part 32 to flow into the bag parts 40 efficiently.

Note that, since the first flow path part 31 and the second flow path part 32 are provided at both ends in the lateral direction and the weight is not applied thereon when the user A lies in a supine position, the air can flow through the first flow path part 31 and the second flow path part 32 even when the first elastic bodies 44 and the second elastic bodies 45 are not provided in the first flow path part 31 and the second flow path part 32.

The first flow path part 31 preferably has therein a first flow path stopper 33 that blocks circulation of the air in the longitudinal direction. In addition, the second flow path part 32 preferably has therein a second flow path stopper 34 that blocks circulation of the air in the longitudinal direction. The first flow path stopper 33 and the second flow path stopper 34 may partially block or completely block circulation of the air in the longitudinal direction. This makes it easy to let the air flow sequentially from the first flow path part 31 to the first bag part 41 and the second flow path part 32, then from the second flow path part 32 to the second bag part 42 and the first flow path part 31, and then from the first flow path part 31 to the third bag part 43 and the second flow path part 32.

Further, the first flow path part 31 may have a third flow path stopper 35 at an end part of the first flow path part 31 opposite an end part thereof where the first path 21 is connected. Furthermore, the second flow path part 32 may have a fourth flow path stopper 36 at an end part of the second flow path part 32 opposite an end part thereof where the third path 23 is connected. The third flow path stopper 35 is made for preventing the air inside the first flow path part 31 from being discharged to the outside, and the fourth flow path stopper 36 is made for preventing the air inside the second flow path part 32 from being discharged to the outside. This enables the air to efficiently circulate through the entire air mattress 100.

Meanwhile, the first flow path stopper 33 and the second flow path stopper 34 are arranged inside the first flow path part 31 and the second flow path part 32 at positions corresponding to positions where the multiple bag parts 40 arranged in the longitudinal direction abut on each other. For example, the first flow path stopper 33 is arranged inside the first flow path part 31 at a position corresponding to a position where the first bag part 41 and the second bag part 42 abut on each other. The second flow path stopper 34 is arranged inside the second flow path part 32 at a position corresponding to a position where the second bag part 42 and the third bag part 43 abut on each other.

At least a part of the surface of the bag parts 40 that is pressed by the user when the user lies thereon is made of at least one of the group consisting of a water-resistant sheet and a moisture-permeable sheet. This enables heat and humidity in the surface pressed by the user to be released to the inside of the bag parts 40 or to the outside of the bag parts 40.

As described previously, the air mattress 100 according to the present embodiment preferably further includes the third path 23 that is supplied with the air from the second flow path part 32 and supplies the air to the supply unit 10. The supply unit 10 preferably circulates the air through the first path 21, the first flow path part 31, the bag parts 40, the second flow path part 32, and the third path 23. In other words, the air flowing inside the air mattress 100 according to the present embodiment preferably circulates.

The air mattress 100 according to the present embodiment preferably also includes a temperature measurement unit 80 that measures the temperature of the circulating air, a humidity measurement unit 81 that measures the humidity thereof, and a feedback controller 82 that is designed to give feedback according to the temperature and humidity from the temperature measurement unit 80 and the humidity measurement unit 81. This makes it possible to grasp the temperature and humidity of the circulating air, which is effective for preventing bedsores. The feedback controller 82 may be implemented by a hardware resource.

The air mattress 100 according to the present embodiment is preferably provided with a unit that heats and cools the circulating air in at least any of the first path 21, the second path 22, and the third path 23. The air mattress 100 according to the present embodiment is preferably also provided with a unit that humidifies and dehumidifies the circulating air in at least any of the first path 21, the second path 22, and the third path 23. This makes it possible to control the temperature and humidity, which is effective for preventing bedsores. In addition, since the air can circulate through the bag parts 40, the air mattress 100 according to the present embodiment makes it possible to significantly improve efficiency in controlling the temperature and humidity of the body surface.

Examples of the heating unit include a heater such as an electrically-heated wire and an electrical heat source, the supply unit 10 having generated waste heat, and adiabatic compression. It is also possible to lower relative humidity by the heater and adiabatic compression.

Examples of the cooling unit include a cooling fin using a Peltier element. Here, what to do in case of dew condensation is to remove water.

Examples of the humidifying unit include a humidifier.

Examples of the dehumidifying unit include a cartridge containing materials such as calcium chloride, silica gel, and zeolite. What to do in a case where the above materials are saturated is to heat them to evaporate moisture contained therein. In addition, what to do in a case where the above materials contained are saturated is to exchange the cartridge or the like.

Further, it is preferable to control the temperature and humidity by using the heating and cooling unit, the humidifying and dehumidifying unit, the temperature measurement unit 80, the humidity measurement unit 81, and the feedback controller 82 in combination. This makes it possible to precisely control the temperature and humidity.

Due to the above, according to the embodiment of the present disclosure, it is possible to circulate the air even when a part of the mattress on the side of the surface where the weight of the user is applied is squashed, and enable body pressure dispersion.

Since the bag parts 40 include therein the first elastic bodies 44 that extend in the lateral direction and in the thickness direction, it is possible to assist in circulation of the air through the bag parts 40.

Since the bag parts 40 have therein the second elastic bodies 45 that extend in the lateral direction and in the thickness direction and are thinner than the first elastic bodies 44, it is possible to prevent at least a part of the bag parts 40, located on the side of the surface where the weight of the user A is applied, from being completely squashed and stopping circulation of the air, thus enabling the air to reliably circulate through the first bag part 41, the second bag part 42, and the third bag part 43.

Since the second elastic bodies 45 extend from the bag parts 40 into a part of the first flow path part 31 and the second flow path part 32, it is possible to cause the air flowing through the first flow path part 31 and the second flow path part 32 to flow into the bag parts 40 efficiently.

Since the multiple bag parts 40 are arranged in the longitudinal direction, it is possible to circulate the air efficiently even when a part of the mattress on the side of the surface where the weight of the user is applied is squashed.

Since the first flow path part 31 has therein the first flow path stopper 33 that blocks circulation of the air in the longitudinal direction at least partially and the second flow path part 32 has therein the second flow path stopper 34 that blocks circulation of the air in the longitudinal direction at least partially, it is possible to let the air flow sequentially from the first flow path part 31 to the first bag part 41 and the second flow path part 32, then from the second flow path part 32 to the second bag part 42 and the first flow path part 31, and then from the first flow path part 31 to the third bag part 43 and the second flow path part 32.

Since the first flow path stopper 33 and the second flow path stopper 34 are arranged inside the first path 21 and the second path 22 at positions corresponding to positions where the multiple bag parts 40 arranged in the longitudinal direction abut on each other, it is possible to circulate the air inside the bag parts 40 efficiently.

Since the air mattress further includes the third path 23 that is supplied with the air from the second flow path part 32 and supplies the air to the supply unit 10 and the supply unit 10 circulates the air through the first path 21, the first flow path part 31, the bag parts 40, the second flow path part 32, and the third path 23, it is possible to control the temperature and humidity inside the bag parts 40 easily.

Since the air mattress further includes the temperature measurement unit 80 that measures the temperature of the circulating air and the feedback controller 82 that is designed to give feedback according to the temperature from the temperature measurement unit 80, it is possible to grasp the temperature of the circulating air, which is effective for preventing bedsores.

Since the air mattress further includes the humidity measurement unit 81 that measures the humidity of the circulating air and the feedback controller 82 that is designed to give feedback according to the humidity from the humidity measurement unit 81, it is possible to grasp the humidity of the circulating air, which is effective for preventing bedsores.

The aforementioned embodiment and modified example are examples embodying the present disclosure, and the present disclosure is not limited to these embodiment and modified example. For example, in each of the aforementioned embodiment and modified example, the present disclosure also includes additions, deletions, or modifications of some elements or steps. In addition, the aforementioned embodiment and modified example may be implemented in combination.

The present disclosure includes the following aspects.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An air mattress comprising:

a supply unit which is configured to supply an air;

a first path and a second path which are supplied with the air from the supply unit;

a first flow path part and a second flow path part which are provided at both ends in a lateral direction of the air mattress and extend in a longitudinal direction of the air mattress, the first flow path part being supplied with the air from the supply unit via the first path, the second flow path part being supplied with the air via the first flow path part;

a bag part whose surface, that is pressed by a user at least when the user lies on the air mattress, is at least partially formed of a moisture-permeable sheet, which is supplied with the air from the first flow path part and causes the air to circulate at least in the lateral direction, and which is provided between the first flow path part and the second flow path part;

a plurality of cells which are arranged below the bag part at a position between a first end of the bag part and a second end of the bag part in the longitudinal direction, which extend in the lateral direction, and which are supplied with the air from the supply unit via the second path; and a pressure controller which is configured to control pressure inside the plurality of cells, wherein the pressure inside the plurality of cells includes a first pressure and a second pressure, the second pressure being lower than the first pressure, among the plurality of cells, the pressure controller sets the pressure inside any one or more of the plurality of cells at the first pressure, sets the pressure inside the cells other than the cells, whose pressure is set at the first pressure, at the second pressure and, among the plurality of cells, sequentially switches the cells between the cells set at the first pressure and the cells set at the second pressure, and when the user lies on the air mattress, the air circulates through at least a part of the bag part located above the cells whose pressure is set at the second pressure.

2. The air mattress according to claim 1, wherein, among the plurality of cells, the pressure controller sets the pressure inside two or more of the plurality of cells at the first pressure, sets the pressure inside the cells, other than the two or more of the plurality of cells, whose pressure is set at the first pressure, at the second pressure and, among the plurality of cells, sequentially switches the cells between the cells set at the first pressure and the cells set at the second pressure.

3. The air mattress according to claim 1, wherein the plurality of cells include a first cell, a second cell, and a third cell, the pressure controller at least executes a first mode in which the pressure inside the second cell and the pressure inside the third cell are set at the first pressure and the pressure inside the first cell is set at the second pressure, which is lower than the first pressure, a second mode in which the pressure inside the first cell and the pressure inside the third cell are set at the first pressure and the pressure inside the second cell is set at the second pressure, and a third mode in which the pressure inside the first cell and the pressure inside the second cell are set at the first pressure and the pressure inside the third cell is set at the second pressure, and when the user lies on the air mattress, the air circulates through at least a part of the bag part located above the first cell, the second cell, and the third cell whose pressure is set at the second pressure.

4. The air mattress according to claim 1, wherein the bag part includes therein a first elastic body that extends in the lateral direction and in a thickness direction thereof.

5. The air mattress according to claim 4, wherein the bag part includes therein a second elastic body that extends in the lateral direction and in the thickness direction and is thinner than the first elastic body.

6. The air mattress according to claim 5, wherein the second elastic body extends from the bag part into a part of the first flow path part and the second flow path part.

7. The air mattress according to claim 1, wherein a plurality of the bag parts are arranged in the longitudinal direction.

8. The air mattress according to claim 7, wherein the first flow path part includes therein a first flow path stopper that blocks circulation of the air in the longitudinal direction at least partially, and the second flow path part includes therein a second flow path stopper that blocks circulation of the air in the longitudinal direction at least partially.

9. The air mattress according to claim 8, wherein the first flow path stopper and the second flow path stopper are arranged inside the first path and the second path at positions corresponding to positions where the plurality of bag parts arranged in the longitudinal direction abut on each other.

10. The air mattress according to claim 1, further comprising:

a third path that is supplied with the air from the second flow path part and supplies the air to the supply unit, wherein the supply unit circulates the air through the first path, the first flow path part, the bag part, the second flow path part, and the third path.

11. The air mattress according to claim 10, further comprising:

a temperature measurement unit that measures temperature of the circulating air; and a feedback controller that is designed to give feedback according to the temperature from the temperature measurement unit.

12. The air mattress according to claim 10, further comprising:

a humidity measurement unit that measures humidity of the circulating air; and a feedback controller that is designed to give feedback according to the humidity from the humidity measurement unit.

* * * * *